US006184179B1

(12) United States Patent
Gilliams et al.

(10) Patent No.: US 6,184,179 B1
(45) Date of Patent: Feb. 6, 2001

(54) SUBSTANTIALLY THERMOGRAPHIC RECORDING MATERIALS WITH IMPROVED STABILITY

(75) Inventors: Yvan Gilliams, Hever; Carlo Uyttendaele, Mortsel; Ingrid Geuens, Emblem; Yvan Hoogmartens, Wilrijk, all of (BE)

(73) Assignee: Agfa-Gevaert, Mortsel (BE)

( * ) Notice: Under 35 U.S.C. 154(b), the term of this patent shall be extended for 0 days.

(21) Appl. No.: 09/306,318

(22) Filed: May 6, 1999

Related U.S. Application Data

(60) Provisional application No. 60/123,446, filed on Mar. 9, 1999.

(30) Foreign Application Priority Data

| | | |
|---|---|---|
| Jun. 6, 1998 | (EP) | 98201963 |
| Aug. 6, 1998 | (EP) | 98202655 |
| Dec. 23, 1998 | (EP) | 98204468 |

(51) Int. Cl.[7] ..... B41M 5/20

(52) U.S. Cl. ..... 503/202; 427/150; 430/617; 430/620; 503/210; 503/214

(58) Field of Search ..... 427/150; 430/617, 430/620; 503/202, 210, 214

(56) References Cited

U.S. PATENT DOCUMENTS 5,883,042 * 3/1999 Defieuw et al. ..... 503/201

* cited by examiner

*Primary Examiner*—Bruce H. Hess
(74) *Attorney, Agent, or Firm*—Baker Botts L.L.P.

(57) ABSTRACT

A thermographic recording material comprising a support and a thermosensitive element containing a substantially light-insensitive silver salt of an organic carboxylic acid, a reducing agent therefor in thermal working relationship therewith and at least one proteinaceous binder, wherein the thermosensitive element contains between 700 ppm and 5 ppm of a non-fluoro-halide ion with respect to the proteinaceous binders in the thermosensitive element and the thermographic recording material is thermally developable under substantially water-free conditions; and a process for the production thereof.

12 Claims, No Drawings

SUBSTANTIALLY THERMOGRAPHIC RECORDING MATERIALS WITH IMPROVED STABILITY

The application claims the benefit of the U.S. Provisional Application Ser. No. 60/123,446, filed Mar. 9, 1999, now abandoned.

FIELD OF THE INVENTION

The present invention relates to thermographic recording materials with improved stability to incident light and improved archivability.

BACKGROUND OF THE INVENTION

Thermal imaging or thermography is a recording process wherein images are generated by the use of thermal energy. In direct thermal thermography a visible image pattern is formed by image-wise heating of a recording material containing matter that by chemical or physical process changes colour or optical density. Such recording materials become photothermographic upon incorporating a photosensitive agent which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

In U.S. Pat. No. 2,910,377 the following statement is made in the description in column 7, lines 23–27: "Stability towards exposure to light is improved by selecting highly purified materials; freedom from halides and sulphides is particularly important in the case of compositions involving silver salts". The disclosure in U.S. Pat. No. 2,910,377 concerned thermographic recording materials coated from solvent media.

WO 94/16361 discloses a multilayer heat-sensitive material which comprises: a colour-forming layer comprising: a colour-forming amount of finely divided, solid colourless noble metal or iron salt of an organic acid distributed in a carrier composition; a colour developing amount of a cyclic or aromatic organic reducing agent, which at thermal copy and printing temperatures is capable of a colour-forming reaction with the noble metal or iron salt; and an image-toning agent; characterized in that (a) the carrier composition comprises a substantially water-soluble polymeric carrier and a dispersing agent for the noble metal or iron salt and (b) the material comprises a protective overcoating layer for the colour-forming layer. WO 94/16361 concerns thermographic materials coated from aqueous media.

Ever tighter solvent emission regulations and measures to avoid solvent explosions, make the avoidance of solvent coating desirable. However, thermographic materials of the type disclosed in WO 94/16361 while being coatable from aqueous media exhibit an inadequate archivability for many applications. Furthermore, the presence of chloride ions in the ingredients has been found to cause poor light stability. There is therefore a need for thermographic recording materials coatable from aqueous media based on substantially light-insensitive organic silver salts with improved shelf-life and stability to light, whose prints exhibit improved archivability and stability to incident light.

OBJECTS OF THE INVENTION

It is therefore an object of the present invention to provide thermographic recording materials coated from aqueous media with improved stability to incident light.

It is therefore another object of the present invention to provide thermographic recording materials which are capable of producing thermographic prints with improved archivability and stability to incident light.

Further objects and advantages of the invention will become apparent from the description hereinafter.

SUMMARY OF THE INVENTION

It is known that conversion of organic silver salts into silver non-fluoro-halides renders thermographic materials photosensitive, since this is the basis of photothermographic materials. This conversion would be expected to occur more readily in aqueous media due to the non-fluoro-halide ions being more mobile in a highly polar medium such as water. The statement made in U.S. Pat. No. 2,910,377 to the effect that the use of highly purified materials improves the light-stability of thermographic materials and in particular freedom from halides and sulphides, concerns thermographic materials coated in solvent media in which the mobility of non-fluoro-halide ions is much lower than in water.

It is therefore surprising that in the presence of gelatin and despite the greater potential for silver halide formation in aqueous media, the expected light instability due to non-fluoro-halide ions only becomes significant, relative to the general stability of the material concerned (dependent upon choice of reducing agent and other ingredients), at non-fluoro-halide ion concentrations above 700 ppm with respect to the gelatin present. This invention enables the use of ingredients in thermographic materials without the exhaustive removal of non-fluoro-halides.

The above objects of the present invention are realized by providing a thermographic recording material comprising a support and a thermosensitive element containing a substantially light-insensitive silver salt of an organic carboxylic acid, a reducing agent therefor in thermal working relationship therewith and at least one proteinaceous binder, wherein the thermosensitive element contains between 700 ppm and 5 ppm of a non-fluoro-halide ion with respect to the proteinaceous binders in the thermosensitive element and the thermographic recording material is thermally developable under substantially water-free conditions.

A process for producing a thermographic recording material as described above is further provided by the present invention comprising the steps of: producing an aqueous dispersion of the substantially light-insensitive silver salt of an organic carboxylic acid; producing one or more aqueous coating compositions containing together the aqueous dispersion of the substantially light-insensitive silver salt of an organic carboxylic acid, the reducing agent and the proteinaceous binder(s); and applying the one or more aqueous coating compositions to the support thereby forming after drying the thermosensitive element.

Preferred embodiments of the present invention are disclosed in the detailed description of the invention.

DETAILED DESCRIPTION OF THE INVENTION

In a preferred embodiment the substantially light-insensitive thermographic recording materials of the present invention are black and white thermographic recording materials.

Definitions

The term aqueous for the purposes of the present invention includes mixtures of water with water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc.

By substantially light-insensitive is meant not intentionally light sensitive. By substantially solvent-free aqueous medium is meant that solvent, if present, is present in amounts below 10% by volume of the aqueous medium.

Heating in a substantially water-free condition as used herein, means heating at a temperature of 80 to 250° C. The term "substantially water-free condition" means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Non-fluoro-halide Ion Concentration in the Thermosensitive Element

According to the present invention a thermographic recording material is provided comprising a support and a thermosensitive element containing a substantially light-insensitive silver salt of an organic carboxylic acid, a reducing agent therefor in thermal working relationship therewith and at least one proteinaceous binder, characterized in that the thermosensitive element contains between 700 ppm and 5 ppm of a non-fluoro-halide ion with respect to the proteinaceous binders in the thermosensitive element. In a preferred embodiment the non-fluoro-halide ion concentration in the thermosensitive element is between 500 ppm and 5 ppm of a non-fluoro-halide with respect to the proteinaceous binders in the thermosensitive element, with between 300 ppm and 5 ppm of a non-fluoro-halide ion with respect to the proteinaceous binders in the thermosensitive element being particularly preferred and between 150 ppm and 5 ppm being especially preferred. The non-fluoro-halide ion is preferably the chloride ion.

Proteinaceous Binders

The non-fluoro-halide ions present in the thermosensitive element may be non-exclusively or exclusively present in the proteinaceous binder(s) used in the thermosensitive element of the thermographic and photothermographic recording materials of the present invention. Therefore the proteinaceous binders in the thermosensitive element may together contain between 700 ppm and 5 ppm of non-fluoro-halide ions and preferably between 500 ppm and 5 ppm and particularly preferably between 300 ppm and 5 ppm and especially between 150 ppm and 5 ppm.

The alkali metal ion concentration of the proteinaceous binder(s) used in the thermosensitive element of the thermographic and photothermographic recording materials of the present invention together of 100 ppm or less.

Suitable proteinaceous binders include gelatin, modified gelatins such as phthaloyl gelatin, zein etc, with gelatin being preferred. Table 1 shows that the chloride ion concentration present in gelatin as determined by ion chromatography using a DIONEX QIC ANALYSER ion chromatograph varies according to gelatin type from 5300 to 17 ppm:

TABLE 1

| GELATIN type | general description | chloride ion concentration [ppm] | sodium ion concentration [ppm] |
|---|---|---|---|
| GEL01 | low viscosity | 5300 | — |
| GEL02 | hydrolyzed gelatin | 2900 | 1700 |
| GEL03 | calcium-free, low viscosity | 1270 | — |
| GEL04 | calcium-free, medium viscosity | 17 | <100 |
| GEL05 | calcium-free, low viscosity | <40 | 2600 |
| GEL06* | calcium-free, low viscosity | <40 | <100 |
| GEL07 | calcium-containing, medium viscosity | ≦250# | — |
| GEL08 | calcium-free, high viscosity | ≦200# | — |
| GEL09 | calcium-free, medium viscosity | ≦150# | — |
| GEL10 | calcium-containing, low viscosity | 150–300# | — |

*type 17881, a gelatin with low potassium ion, sodium ion and chloride-ion concentrations from AGFA-GEVAERT GELATINEFABRIEK vorm. KOEPFF & SÖHNE
#specification

Thermosensitive Element

According to the present invention, a substantially light-insensitive thermographic recording material is provided comprising a thermosensitive element containing a substantially light-insensitive silver salt of an organic carboxylic acid, an organic reducing agent therefor in thermal working relationship therewith and a binder. The thermosensitive element may comprise a layer system in which the ingredients are dispersed in different layers, with the proviso that the substantially light-insensitive silver salt of an organic carboxylic acid and the organic reducing agent are in thermal working relationship with one another i.e. during the thermal development process the reducing agent must be present in such a way that it is able to diffuse to the particles of substantially light-insensitive silver salt of an organic carboxylic acid so that reduction of the silver salt of an organic carboxylic acid can take place. The thickness of the thermosensitive element is preferably in the range of 1 to 50 $\mu$m.

In a preferred embodiment of the present invention the thermosensitive element further contains a photosensitive silver halide, making thermographic recording material photothermographic.

Silver Salts of an Organic Carboxylic Acid

Preferred substantially light-insensitive silver salts of an organic carboxylic acid used in the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention.

Auxiliary Film-forming Binders of the Thermosensitive Element

Suitable water-dispersible binders for use as auxiliary binders in the thermographic and photothermographic recording materials of the present invention may be any water-insoluble polymer It should be noted that there is no clear cut transition between a polymer dispersion and a polymer solution in the case of very small polymer particles resulting in the smallest particles of the polymer being dissolved and those slightly larger being in dispersion. Preferred water-dispersible binders for use according to the present invention are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders for use according the present invention are water-dispersible film-forming polymers with covalently bonded moieties with one or more acid groups.

Thermal Solvents

The above mentioned binders or mixtures thereof may be used in conjunction with waxes or "heat solvents" also called "thermal solvents" or "thermosolvents" improving the reaction speed of the redox-reaction at elevated temperature.

Organic Reducing Agents

Suitable organic reducing agents for the reduction of silver salt of an organic carboxylic acid particles are organic compounds containing at least one active hydrogen atom linked to O, N or C.

Catechol-type reducing agents, i.e. reducing agents containing at least one benzene nucleus with two hydroxy groups (—OH) in ortho-position are preferred with those described in EP-B 692 733 and EP-A 903 625 being particularly preferred. Other suitable reducing agents are sterically hindered phenols, bisohenols and sulfonamidophenols.

Combinations of reducing agents may also be used that on heating become reactive partners in the reduction of the substantially light-insensitive silver salt of an organic carboxylic acid. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. Nos. 5,545,515 and 5,635,339; and 2-substituted malonodialdehyde compounds as disclosed in U.S. Pat. No. 5,654,130.

Toning Agents

In order to obtain a neutral black image tone in the higher densities and neutral grey in the lower densities, the thermographic and photothermographic recording materials according to the present invention may contain one or more toning agents. The toning agents should be in thermal working relationship with the substantially light-insensitive silver salt of an organic carboxylic acid and reducing agents during thermal processing. Any known toning agent from thermography or photothermography may be used. Suitable toning agents are the phthalimides and phthealazinones within the scope of the general formulae described in U.S. Pat. No. 4,082,901 and the toning agents described in U.S. Pat. Nos. 3,074,809, 3,446,648 and 3,844,797. Particularly useful toning agents are the heterocyclic toner compounds of the benzoxazine dione or naphthoxazine dione type described in GB-P 1,439,478, U.S. Pat. Nos. 3,951,660 and 5,599,647.

Stabilizers and Antifoggants

In order to obtain improved shelf-life and reduced fogging, stabilizers and antifoggants may be incorporated into the thermographic recording materials of the present invention.

Polycarboxylic Acids and Anhydrides Thereof

According to the recording material of the present invention the thermosensitive element may comprise in addition at least one polycarboxylic acid and/or anhydride thereof in a molar percentage of at least 15 with respect to all the silver salt of an organic carboxylic acid(s) present and in thermal working relationship therewith. The polycarboxylic acid may be aliphatic (saturated as well as unsaturated aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Surfactants and Dispersants

Surfactants are surface active agents which are soluble compounds which reduce the interfacial tension between a liquid and a solid. The thermographic and photothermographic recording materials of the present invention may contain anionic, non-ionic or amphoteric surfactants e.g.:

| | |
|---|---|
| Surfactant Nr. S01 | = ammonium dodecylphenylsultonate; |
| Surfactant Nr. S02 | = N, N-dimethyl-N-hexadecyl-ammonio-acetic acid; |
| Surfactant Nr. S03 | = MARLON ™ A-365, supplied as a 65% concentrate of a sodium alkyl-phenylsulfonate by HÜLS. |
| Surfactant Nr. S04 | = AKYPO ™ OP 80, supplied by CHEMY as an 80% concentrate of an octyl-phenyl-oxy-polyethylene-glycol (EO 8) acetic acid; |
| Surfactant Nr. S05 | = hexadecyl-dimethylammonium acetic acid; |
| Surfactant Nr. S06 | = acid form of ULTRAVO ™ W from CIBA-GEIGY; |
| Surfactant Nr. S07 | = ULTRAVON ™ W, an aryl sulfonate from CIBA-GEIGY |
| Surfactant Nr. S08 | = ARKOPAL ™ N060 (previously HOSTAPAL ™ W), a nonylphenylpolyethylene-glycol from HOECHST |
| Surfactant Nr. S09 | = SAPONINE QUILAYA, containing 10% of saponines, 15% of tannins, 11% of calcium oxalate and 64% of starch from SCHMITTMANN; |
| Surfactant Nr. S10 | = NIAPROOF ANIONIC ™ 4, supplied as a 27% concentrate of a sodium 1-(2'-ethylbutyl)-4-ethylhexylsulphate by NIACET; |
| Surfactant Nr. S11 | = ammonium salt of perfluoro-octanoic acid. |

Suitable dispersants are natural polymeric substances, synthetic polymeric substances and finely divided powders, for example finely divided non-metallic inorganic powders such as silica.

Other Ingredients

In addition to the ingredients the substantially light-insensitive thermographic recording material may contain other additives such as free fatty acids, silicone oil, ultraviolet light absorbing compounds, white light reflecting and/or ultraviolet radiation reflecting pigments, silica, and/or optical brightening agents.

Support

The support for the substantially light-insensitive thermographic recording material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form. The support may be subbed with a subbing layer. It may also be made of an opacified resin composition.

Protective Layer

In a preferred embodiment of the thermographic recording material according to the present invented the thermosensitive element is provided with a protective layer. A protective layer protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. In a particularly preferred embodiment of the thermographic recording material of the present invention, the protective layer is exclusive of proteinaceous binders.

The protective layer may comprise a dissolved lubricating material and/or particulate material, e.g. talc particles, optionally protruding therefrom. Examples of suitable lubricating materials are a surface active agent, a liquid lubricant, a solid lubricant or mixtures thereof, which may be used with or without a polymeric binder.

Layer on Opposite Side of the support to the Thermosensitive Element

The thermographic recording material according to the present invention may be provided with a layer containing a second proteinaceous binder on the opposite side of the support to the thermosensitive element protective layer.

Photosensitive Silver Halide

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Spectral Sensitization

The photosensitive silver halide in the photo-addressable thermally developable element of the photothermographic recording material, according to the present invention, may be spectrally sensitized with a spectral sensitizer, optionally together with a supersensitizer.

Antihalation Dyes

The thermographic recording materials used in the present invention may also contain antihalation or acutance dyes which absorb light which has passed through the photosensitive thermally developable photographic material, thereby preventing its reflection. Such dyes may be incorporated into the photosensitive thermally developable photographic material or in any other layer of the photographic material of the present invention.

Coating

The coating of any layer of the substantially light-insensitive thermographic recording materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA.

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head. Heating takes place in a substantially water-free condition.

In thermal printing, image signals are converted into electric pulses and then through a driver circuit selectively transferred to a thermal printhead. The thermal printhead consists of microscopic heat resistor elements, which convert the electrical energy via the Joule effect into heat, which is transferred to the surface of the thermographic recording material wherein the chemical reaction resulting in the development of a black and white image takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly e.g. from opto-electronic scanning devices or from an intermediary storage means, optionally linked to a digital image work station wherein the image information can be processed to satisfy particular needs. Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulsewise.

When used in thermographic recording operating with thermal printheads the thermographic recording materials are not suitable for reproducing images with fairly large number of grey levels as is required for continuous tone reproduction. EP-A 622 217 discloses a method for making an image using a direct thermal imaging element producing improvements in continuous tone reproduction.

Image-wise heating of the thermographic recording material can also be carried out using an electrically resistive ribbon incorporated into the material. Image- or pattern-wise heating of the thermographic recording material may also proceed by means of pixelwise modulated ultra-sound, using e.g. an ultrasonic pixel printer as described e.g. in U.S. Pat. No. 4,908,631.

Photothermographic Printing

Photothermographic recording materials, according to the present invention, may be exposed with radiation of wavelength between an X-ray wavelength and a 5 microns wavelength with the image either being obtained by pixelwise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UW, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Industrial Application

Thermographic recording materials according to the present invention may be used for both the production of transparencies, for example in the medical diagnostic field in which black-imaged transparencies are widely used in inspection techniques operating with a light box, and reflection type prints, for example in the hard copy field. For such applications the support will be transparent or opaque, i.e. having a white light reflecting aspect. Should a transparent base be used, the base may be colourless or coloured, e.g. with a blue colour for medical diagnostic applications.

The following examples and comparative examples illustrate the present invention. The percentages and ratios used in the examples and compositions of the ingredients are by weight unless otherwise indicated.

i) backing layer ingredients:

KELZAN™ S, a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PERAPRE™ PE40, a 40% aqueous dispersion of polyethylene latex from BASF;

LATEX02, a 20% by weight dispersion of polymethyl methacrylate with an average particle size of 88.8 nm prepared as described in U.S. Pat. No. 5,354,613;

LATEX03, a 15% dispersion of a terpolymer of 18 mol % methyl acrylate, 79 mol % potassium salt of acrylic acid and 3 mol % TAOE;

LATEX04, a 20% dispersion of a 1 $\mu$m polymethylmethacrylate latex;

KIESELSOL™ 100F, a colloidal silica from BAYER;

KIESELSOL™ 300F, a colloidal silica from BAYER;

PLEXIGUM™ M345, a polymethylmethacrylate type from ROHM;

ii) thermosensitive element ingredients (in addition to those mentioned above):

| | |
|---|---|
| AgBeh | = silver behenate; |
| R01 | = ethyl 3,4-dihydroxybenzoate, a reducing agent containing 470 ppm of chloride ions; |
| R02 | = propyl gallate, a reducing agent containing 654 ppm of chloride ions; |
| T01 | = 7-(ethylcarbonato)benzo[e][1,3]oxazine-2,4-dione, a toning agent containing 500 ppm of chloride ions |
| T02 | = phthalazinone containing less than 100 ppm of chloride ions; |
| T03 | = benzo[e][1,3]oxazine-2,4-dione containing 0.7 ppm of chloride ions; |
| LATEX 01 | = a terpolymer of 42% butyl acrylate, 53% styrene, 2% itaconic acid and 3% of the ammonium salt of N-[(4'-sulfobenzamido)-oxo-decyl]methacrylamide; |
| POLY01 | = POLYVIOL ™ WX48 20, a polyvinylalcohol from WACKER CHEMIE, contains 545 ppm of chloride ions; |
| POLY02 | = Polyvinylpyrrolidone, contains 1.5 ppm of chloride ions; |

and iii) in the protective layer:

POLYVIOL™ WX48 20, a polyvinylalcohol from WACKER CHEMIE;

RILANIT™ GMS, a glycerine monotallow acid ester, from HENKEL AG

MICROACE TALC P3, an Indian talc from NIPPON TALC;

SERVOXYL™ VPAZ 100, a mixture of monolauryl and dilauryl phosphate, from SERVO DELDEN B.V.;

SERVOXYL™ VPDZ 3/100, a mono[isotridecyl polyglycolether (3 EO)] phosphate, from SERVO DELDEN B.V.;

LEVASIL™ VP AC 4055, a 15% aqueous dispersion of colloidal silica with acid groups predominantly neutralized with sodium ions and a specific surface are of 500 $m^2/g$, from BAYER AG has been converted into the ammonium salt.

INVENTION EXAMPLES 1 TO 3

Thermographic Composition I

Preparation of Silver Behenate Dispersions

Silver behenate was added with stirring to an aqueous solution of ammonium dodecylsulfonate (Surfactant Nr. SOI) and the mixtures stirred for 30 minutes with a KOTTHOFF™ stirrer. The resulting dispersions were then ball-milled to obtain a finely divided 18.5% by weight aqueous dispersion of silver behenate with 1 g of a 0.1 g of ammonium dodecylsulfonate per g silver behenate.

Preparation of the Thermographic Recording Materials 3.23 g of GEL05 (gelatin) was allowed to swell in 15.986 g of deionized water for 30 minutes and the swollen GEL05 was heated up to 36° C. The following ingredients were then added with stirring: 4.434 g of a 20% aqueous solution of T02 followed by 5 minutes stirring, then 24.20 g of the silver behenate dispersion at a temperature of 36° C. followed by 10 minutes stirring, then 11.150 g of an aqueous solution containing 5.55% of boric acid, 8.17% of R01 and 15.23% of ethanol was added and finally 1.0 g of an aqueous solution containing 19.2% of formaldehyde and 6.75% of methanol. The dispersions for INVENTION EXAMPLES 1 to 3 contained the concentrations of chloride and sodium ions with respect to the gelatin present given in table 2.

The resulting silver behenate dispersions were then doctor blade-coated onto a 175 μm thick subbed polyethylene terephthalate support to produce the coating weights of silver given in table 2.

Thermographic Printing

The printer was equipped with a thin film thermal head with a resolution of 300 dpi and was operated with a line time of 19 ms (the line time being the time needed for printing one line). During this line time the printhead received constant power. The average printing power, being the total amount of electrical input energy during one line time divided by the line time and by the surface area of the heat-generating resistors was 1.6 mJ/dot being sufficient to obtain maximum optical density in each of the substantially light-insensitive thermographic recording materials of INVENTION EXAMPLES 1 to 3.

The maximum densities, $D_{max}$, and minimum densities, $D_{min}$, of the prints given in table 2 were measured through visible or blue filters with a MACBETH™ TR924 densitometer in the grey scale step corresponding to data levels of 64 and 0 respectively and are given in table 2.

Light Box Test

The stability of the image background of the prints made with the substantially light-insensitive thermographic recording materials of INVENTION EXAMPLES 1 to 3 was evaluated on the basis of the change in minimum (background) density measured through a blue filter using a MACBETH™ TR924 densitometer upon exposure on top of the white PVC window of a specially constructed light-box placed for 3 days in a VÖTSCH conditioning cupboard set at 30° C. and a relative humidity (RH) of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX™ TLD 36W/54 fluorescent lamps 27 mm in diameter mounted length-wise equidistant from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in table 2.

The results of the thermographic evaluation of the thermographic recording material of INVENTION EXAMPLES 1 to 3 show no significant photo-instability in the light-box test indicating that up to a chloride ion concentration of 201 ppm with respect to the gelatin present there is no adverse effect of the chloride ion content upon the light stability of thermographic recording materials with the very stable THERMOGRAPHIC COMPOSITION I used.

TABLE 2

| Invention | AgBeh | | concentrations of ions with respect to gelatin present | | fresh | | Light box: $\Delta D_{max}/\Delta D_{min}$ blue |
|---|---|---|---|---|---|---|---|
| example number | coverage [g/m²] | gelatin | [Cl⁻] [ppm] | [Na⁻] [ppm] | $D_{max}$ blue | $D_{min}$ blue | after 3 days at 30° C./85% RH |
| 1 | 3.4 | GEL05 | 201 | 44 | 2.26 | 0.05 | +0.14/+0.01 |
| 2 | 3.7 | GEL05 | 167 | 22 | 2.63 | 0.05 | −0.07/+0.01 |
| 3 | 3.7 | GEL05 | 140 | 4 | 2.43 | 0.05 | +0.22/+0.02 |

COMPARATIVE EXAMPLES 1 & 2 AND INVENTION EXAMPLES 4 to 6

Thermographic Composition II

Preparation of a Tone Modifier Dispersion

The tone modifier dispersion was prepared by first dissolving 8.8 g of GEL05 in 71.4 g of deionized water by first adding the gelatin, then allowing the gelatin to swell for 30 minutes and finally heating to 50° C. 20 g of T01 was added with ULTRA-TURRAX™ stirring to this gelatin solution at 50° C., and the stirring continued for a further 5 minutes. Finally the resulting dispersion was pumped through a DYNOMILL™ for 2 hours to produce the final tone modifier dispersion containing: 20% of T01 and 8.8% of GEL05.

Preparation of Thermographic Recording Materials

Aqueous silver behenate dispersion was first prepared as described for INVENTION EXAMPLES 1 to 3 except that the surfactant used was Surfactant Nr. S03 and was present at a concentration of 0.1 g/g silver behenate and the silver behenate concentration was 16.9%.

The coating dispersion for the thermosensitive element was produced by first adding 2.059 g of gelatin (for the type see table 3) to 7.64 g of deionized water or in the case of COMPARATIVE EXAMPLE 1 2.059 g of gelatin (for the type see table 3) together with 1.949 g of GEL02 to 13.11 g of deionized water, allowing the gelatin to swell for 30 minutes and then heating the mixture to 36° C. then adding the following solutions and dispersions with stirring while maintaining a temperature of 36° C.: 6.93 g of the toner modifier dispersion as flakes (contains GEL05), then for COMPARATIVE EXAMPLE 2 and INVENTION EXAMPLES 4 to 6: 7.430 g of a 26.2% dispersion of LATEX 02, then 30.72 g of the aqueous silver behenate dispersion followed by stirring, then 12.35 g of an aqueous solution containing 2.78% of boric acid, 8.17% of R01 and 15.23% of ethanol and finally 2.88 g of a 3.7% aqueous solution of formaldehyde. The chloride and sodium ions present in the dispersion only arise from the gelatin used.

The coating dispersion was doctor-blade coated at a pH of ca. 5.4 onto a 175 μm thick subbed polyethylene terephthalate support to provide, after drying in a drying cupboard at 50° C., the thermographic recording materials of COMPARATIVE EXAMPLES 1 & 2 and INVENTION EXAMPLES 4 to 6 with the silver behenate coating weights given in table 3 below.

TABLE 3

| | AgBeh | binder | GELATIN | | total $[Cl^-]$ vs | fresh | | Light box: $\Delta D_{max}/\Delta D_{min}$ blue |
|---|---|---|---|---|---|---|---|---|
| | coverage $[g/m^2]$ | % as LATEX 02 | type | $[Cl^-]$ [ppm] | gelatin [ppm] | $D_{max}$ blue | $D_{min}$ blue | after 3 days at 30° 0./85% RH |
| Comparative example number | | | | | | | | |
| 1 | 4.35 | 0 | (38%) GEL02<br>(62%) GEL05 | 2900<br><40 | 3153 | 3.57 | 0.10 | +C.52/+0.07 |
| 2 | 4.21 | 38 | GEL03 | 1270 | 1707 | 3.26 | 0.10 | +0.19/+0.10 |
| Invention example number | | | | | | | | |
| 4 | 4.24 | 38 | (76%) GEL04<br>(24%) GEL05 | 17<br><40 | 454 | 3.15 | 0.10 | +0.24/+0.01 |
| 5 | 4.11 | 38 | GEL05 | <40 | 437 | 3.38 | 0.10 | +0.03/+0.01 |
| 6 | 4.35 | 38 | (76%) GEL06<br>(24%) GEL05 | <40<br><40 | 437 | 3.18 | 0.10 | +0.17/+0.02 |

The results of the thermographic evaluation of the thermographic recording materials of COMPARATIVE EXAMPLES 1 & 2 show a significant increase in $D_{min}$ i.e. 0.07 and 0.10 respectively after the light box test as can be seen from table 3, whereas the thermographic recording materials of INVENTION EXAMPLES 4 to 6 show increases in $D_{min}$ of 0.02 or less after the light box test indicating that for chloride concentrations above 1500 ppm with respect to gelatin, thermographic recording materials of THERMOGRAPHIC COMPOSITION II exhibit significant photo-instability in the light-box test, whereas at chloride ion concentrations of 500 ppm or less with respect to gelatin, there is no significant photo-instability during this test.

COMPARATIVE EXAMPLE 3 AND INVENTION EXAMPLE 7

Thermographic Composion III

Aqueous silver behenate dispersions were prepared as described for INVENTION EXAMPLES 1 to 3 except that the surfactant used was that given in table 3 and was present at a concentration of 0.1 g/g silver behenate and the silver behenate concentration was 21%.

The coating dispersion for the thermosensitive element was produced by first adding 0.31 g of boric acid and 3.942 g of gelatin (for the type see table 4) to 19.46 g of deionized water, allowing the gelatin to swell for 30 minutes and then heating the mixture to 36° C. then adding the following solutions and dispersions with stirring while maintaining a temperature of 36° C.: 4.93 g of the toner modifier dispersion as flakes, then a solution of 1 g of R01 in 3 g of deionized water and 1 g of ethanol at 50° C. then 1.98 g of deionized water and finally by 25.36 of a 21% dispersion of silver behenate with 0.1 g of surfactant/g silver behenate. The chloride and sodium ions present in the dispersion only arise from the gelatin used.

The coating dispersion was doc-or-blade coated at a pH of ca. 5.0 onto a 175 $\mu$m thick subbed polyethylene terephthalate support to provide, after drying in a drying cupboard at 50° C., the thermographic recording materials of COMPARATIVE EXAMPLE 3 and INVENTION EXAMPLES 7 with the silver behenate coating weights given below.

Thermographic Evaluation

Thermographic evaluation was carried out as described for INVENTION EXAMPLES 1 to 3 and the results are given in table 4 below. The results of INVENTION EXAMPLE 5 cannot be directly compared with those of INVENTION EXAMPLE 7, because THERMOGRAPHIC COMPOSITION II of INVENTION EXAMPLES 4 to 6 and COMPARATIVE EXAMPLES 1 & 2 is more stable than THERMOGRAPHIC COMPOSITION III of INVENTION EXAMPLE 7 and COMPARATIVE EXAMPLE 3. However, the trend observed for the results with THERMOGRAPHIC COMPOSITION II is also to be found in the results obtained with THERMOGRAPHIC COMPOSITION III i.e. that the thermographic recording material of COMPARATIVE EXAMPLE 3 with a chloride ion concentration greater than 1500 ppm exhibited significant photo-instability in the light-box test, whereas the thermographic recording material of INVENTION EXAMPLE 7 with less than 500 ppm of chloride ions with respect to the gelatin exhibited no significant photo-instability in the light-box test in the context of the lower general stability of THERMOGRAPHIC COMPOSITION III.

TABLE 4

| | AgBeh | binder | GELATIN | | total [Cl⁻] vs | fresh | | Light box: $\Delta D_{max}/\Delta D_{min}$ blue |
|---|---|---|---|---|---|---|---|---|
| | coverage [g/m²] | % as LATEX 01 | type | [Cl⁻] [ppm] | gelatin [ppm] | $D_{max}$ blue | $D_{min}$ blue | after 3 days at 30° C./85% RH |
| Comparative example number 3 | 4.53 | S03 | (89%) GEL01<br>(11%) GEL05 | 5300<br><40 | 5544 | 2.66 | 0.10 | +0.17/+0.63 |
| Invention example number 7 | 4.40 | S02 | GEL05 | <40 | 244 | 2.95 | 0.10 | +0.02/+0.04 |

INVENTION EXAMPLES 8 AND 9

Thermographic Composition IV

Preparation of Subbing Layers

Subbing Layer Number 01:

A 0.34 mm thick polyethylene terephthalate sheet was coated to a thickness of 0.1 mm with a composition which after drying and longitudinal and transverse stretching produced a 175 mm thick support coated with the following subbing-layer composition expressed as the coating weights of the ingredients present:

#terpoolyrer latex of vinylidene chloride/methyl acrylate/itaconic acid (88/10./2): 162 mg/m²

#colloidal silica (KIESELSOL™ 100F from BAYER) 38 mg/m²

#alkyl sulfonate surfactant (Surfactant Nr. 2): 0.6 mg /m² aryl sulfonate surfactant (Surfactant Nr. 3): 4 mg/m²

Subbing Layer Number 02:

A 0.34 mm thick polyethylene terephthalate sheet was coated to a thickness of 0.1 mm with a composition which after drying and longitudinal and transverse stretching produced a 175 mm thick support coated on with the following subbing-layer composition of subbing layer number 01 expressed as the coating weights of the ingredients present:

| | |
|---|---|
| # copolymer of terephthalic acid/isophthalic acid/sulfo-isophthalic acid/ethylene glycol 26.5/20/3.5/50): | 37.0 mg/m² |
| # copolymer latex of ethyl acrylate/methacrylic acid (80/20): | 3.0 mg/m² |
| # HORDAMER ™ PE02: | 1.0 mg/m² |
| # PAREZ RESIN ™ 707: | 7.0 mg/m² |

Quantity of Leachable Non-fluoro-halide Ions Per Unit Surface of Subbing Layers The chloride-ion content leachable during overcoating with an aqueous dispersion or solution was simulated by placing a 10×5 cm² piece of subbing layer-coated polyethylene terephthalate in 25 mL of deionized water for a period of 2 hours and determining the quantity of chloride ions leached out by injecting samples of the leaching water directly into a DIONEX QIK ANALYSER ion chromatograph The detection limit with these measurements was limited to 0.1 ppm by the deionized water used in the leaching experiments, which had a chloride ion concentration of 0.02 to 0.06 ppm. The results obtained are given below in table 1:

Wavelength dispersive X-ray fluorescence (WDXRF) measurements were carried out on some of the supports to obtain a qualitative estimate of the total chlorine constant of the supports i.e. both covalently bound chlorine and chloride ions. These showed no detectable chlorine in an uncoated support, a very small quantity in subbing layer number 02 and a small quantity in subbing layer 01. The quantity of leachable chloride ions in the different subbing layers obtained from these measurements are summarized in table 5:

TABLE 5

| Subbing layer number | Quantity of leachable chloride ions [mg/m² surface] |
|---|---|
| 01 | 0.65 |
| 02 | 0.3 |

Preparation of the Silver Behenate Dispersion

The silver behenate dispersion was produced as follows: dispersing 25 kg (73.5M) behenic acid was dispersed with stirring at 80° C. in 100 L of a 10% solution of Surfactant Nr 5/g behenic acid made up to 250 L with deionized water at a temperature of 80° C.; then 36.75 L of a 2M aqueous solution of sodium hydroxide was added over a period of 10 to 20 minutes to give a clear solution substantially containing sodium behenate; then 25 L of a 2.94M aqueous solution of silver nitrate was added with stirring at a rate of 0.163 moles/moles silver behenate·min to convert the sodium behenate completely into silver behenate; and finally ultrafiltration was carried out with a 500000 MW polysulfone cartridge filter at room temperature to concentrate the resulting silver behenate dispersion, the final AgBeh-concentration was 16.7% with 0.07 g of Surfactant Mr 5/g AgBeh, the residual conductivity was 1.0 mS/cm.

Preparation of the Thermosensitive Element

175 μm thick blue pigmented polyethylene terephthalate supports coated with subbing layer numbers 01 & 02 were coated with an aqueous coating composition and the following ingredients so to obtain thereon after drying, a thermosensitive element containing:

| | |
|---|---|
| *AgBeh: | 4.94 g/m² |
| *GEL05: | 4.96 g/m² |
| *formaldehyde | 0.2 g/m² |
| *Surfactant Nr. S01 | 0.32 g/m² |
| *Surfactant Nr. S04 | 0.004 g/m² |
| *Surfactant Nr. S05 | 0.13 g/m² |
| *R01 | 1.00 g/m² |

-continued

| | |
|---|---|
| *T03 | 0.53 g/m$^2$ |
| *boric acid | 0.18 g/m$^2$ |
| *ammonium tetraborate | 0.48 g/m$^2$ |

and to produce the thermographic recording materials of INVENTION EXAMPLES 8 and 9 respectively in which the thermosensitive elements contain, taking into account the leachable chloride ions from the subbing layers used of 239 ppm and 168 ppm of chloride ions with respect to gelatin.

Evaluation

Thermographic evaluation was carried out as described above for COMPARATIVE EXAMPLES 1 to 3 and INVENTION EXAMPLES 1 & 2 except the archivability tests were carried out for 4 days at 45° C. and 70% relative humidity instead of 3 days at 35° C. and 80% relative humidity. The results are summarized in table 6.

TABLE 6

| Invention example number | AgBeh coverage [g/m$^2$] | Total $Cl^-$ ions versus gelatin [ppm] | Leachable $Cl^-$-ions from subbing layer layer nr | mg/m$^2$ | FRESH $D_{max}$ vis/blue | $D_{min}$ vis blue | Archivability: $\Delta D_{min}$ vis/blue after 4d at 45° C./70% RH | Light box $\Delta D_{min}$ vis/blue after 3d at 30° C./85% RH |
|---|---|---|---|---|---|---|---|---|
| 8 | 4.94 | 239 | 01 | 0.65 | 3.12/3.23 | 0.23/0.10 | 0.01/0.02 | 0.02/0.04 |
| 9 | 4.94 | 168 | 02 | 0.30 | 2.65/2.71 | 0.21/0.10 | 0.00/0.01 | 0.01/0.01 |

These results are consistent with those of INVENTION EXAMPLES 1 to 7 and show that these thermographic recording materials of THERMOGRAPHIC COMPOSITION IV with chloride ion concentrations below 500 ppm (239 and 168 ppm respectively) with respect to gelatin exhibit no significant photo-instability in the light-box test.

INVENTION EXAMPLES 10 TO 12 AND COMPARATIVE EXAMPLES 4 to 6

Thermographic Composition V

175 $\mu$m thick polyethylene terephthalate supports coated with subbing layer number 01 was coated with an aqueous coating composition and the following ingredients to obtain thereon after drying thermosensitive elements compositions of the thermographic recording materials of COMPARATIVE EXAMPLES 4 to 6 and INVENTION EXAMPLES 10 to 12 as given in table 7:

TABLE 7

| | binder type | binder coverage [g/m$^2$] | AgBeh [g/m$^2$] | Surfactant NR S03 [g/m$^2$] | R01 [g/m$^2$] | R02 [g/m$^2$] | tone modifier type | tone modifier [g/m$^2$] |
|---|---|---|---|---|---|---|---|---|
| Comparative example nr. | | | | | | | | |
| 4 | POLY01 | 3.78 | 4.11 | 0.411 | — | 0.975 | T01 | 1.038 |
| | GEL05 | 0.33 | | | | | | |
| 5 | POLY01 | 3.83 | 4.16 | 0.416 | — | 0.986 | T02 | 0.611 |
| | GEL05 | 0.33 | | | | | | |
| 6 | POLY02 | 3.01 | 4.93 | 0.493 | 1.010 | — | T03 | 0.809 |
| | GEL05 | 0.39 | | | | | | |
| Invention example nr. | | | | | | | | |
| 10 | GEL05 | 4.00 | 4.00 | 0.400 | — | 0.948 | T01 | 0.893 |
| 11 | POLY02 | 1.93 | 4.48 | 0.448 | 0.917 | — | T03 | 0.735 |
| | GEL05 | 2.55 | | | | | | |
| 12 | GEL05 | 3.95 | 3.95 | 0.395 | — | 0.937 | T02 | 0.580 |

Thermographic Evaluation

Thermographic evaluation was carried out as described for INVENTION EXAMPLES 1 to 3 and the results are given in table 8.

TABLE 8

| | AgBeh coverage [g/m²] | non-gelatin binder type | % | GELATIN type | [Cl⁻] [ppm] | total [Cl⁻] vs gelatin [ppm] | fresh $D_{max}$ blue | fresh $D_{min}$ blue | Light box: $\Delta D_{max}/\Delta D_{min}$ blue after 3 days at 30° C./85% RH |
|---|---|---|---|---|---|---|---|---|---|
| Comparative example number | | | | | | | | | |
| 4 | 4.11 | POLY01 | 92 | GEL05 | <40 | 11717 | 4.00 | 0.17 | −0.20/+0.43 |
| 5 | 4.16 | POLY01 | 92 | GEL05 | <40 | 8279 | 3.50 | 0.21 | +0.20/+0.28 |
| 6 | 4.93 | POLY02 | 92.6 | GEL05 | <40 | 1680 | 2.90 | 0.13 | −0.60/+0.41 |
| Invention example number | | | | | | | | | |
| 10 | 4.00 | — | — | GEL05 | <40 | 429 | 4.10 | 0.12 | −0.10/+0.08 |
| 11 | 4.48 | POLY02 | 43 | GEL05 | <40 | 257 | 3.60 | 0.11 | −0.30/+0.09 |
| 12 | 3.95 | — | — | GEL05 | <40 | 320 | 4.10 | 0.08 | +0.40/+0.06 |

The light-box results for the thermographic recording materials of COMPARATIVE EXAMPLES 4 to 6 with chloride ion concentrations with respect to gelatin above 1500 ppm with $\Delta D_{min}$-values of 0.28 to 0.43 show much stronger photo-instability than with the thermographic recording materials of INVENTION EXAMPLES 10 to 12 with chloride ion concentrations below 500 ppm with respect to gelatin with $\Delta D_{min}$-values of 0.06 to 0.09. This is attributable to the higher concentration of chloride ions therein.

The photoinstability ($\Delta D_{min}$ increase) in the light-box test with the thermographic recording materials of INVENTION EXAMPLES 10 to 12, with less than 500 ppm of chloride ions with respect to gelatin, is not dependent upon the chloride ion concentration and hence can be attributed to the lower stability of the THERMOGRAPHIC COMPOSITION V in general and not to the chloride ion concentration in particular. Therefore in the context of the lower stability of THERMOGRAPHIC COMPOSITION V, there is no significant photo-instability attributable to the chloride ion concentration in the light-box test results for the thermographic recording materials of INVENTION EXAMPLES 10 to 12 with less than 500 ppm of chloride ions with respect to gelatin.

Therefore, the trend observed with the results obtained with THERMOGRAPHIC COMPOSITIONS II and III is also to be found in the results obtained with THERMOGRAPHIC COMPOSITION V i.e. the thermographic recording materials of COMPARATIVE EXAMPLES 4 to 6 with chloride ion concentrations greater than 1500 ppm with respect to gelatin exhibited significant photo-instability in the light-box test due to the presence of chloride ions, whereas there was no photo-instability in the light-box tests for the thermographic recording materials of INVENTION EXAMPLES 10 to 12 with chloride ion concentrations below 500 ppm with respect to gelatin, which is directly attributable to the presence of chloride ions.

INVENTION EXAMPLES 14 AND 15

Backside Layers

A 175 μm thick polyethylene terephthalate support coated on both sides with subbing layer 01 was coated on one side with backside layer B01 with the following composition:

| | |
|---|---|
| KELZAN ™ S | 10 mg/m² |
| polyethylenedioxythiophene | 5 mg/m² |
| polystyrene sulfonic acid | 10 mg/m² |
| Surfactant Nr. S07 | 21 mg/m² |
| PERAPRET ™ PE40 | 10 mg/m² |
| KIESOLSOL ™ 100F | 20 mg/m² |
| PMMA latex | 200 mg/m² |
| LATEX02 | 30 mg/m² |

A 175 μm thick polyethylene terephthalate support coated on both sides with subbing layer 01 was also coated on one side with backside layer packet B02. First a layer with the following composition was coated:

| | |
|---|---|
| GEL07 | 380 mg/m² |
| KIESELSOL 300F | 340.7 mg/m² |
| Surfactant Nr S07 | 13.3 mg/m² |
| Surfactant Nr. S08 | 6.7 mg/m² |
| 2-methyl-2,4-pentanediol | 22.2 mg/m² |
| Trimethylolpropane | 11.1 mg/m² |
| PMMA latex | 1 mg/m² |

then with a layer with the following composition:

| | |
|---|---|
| GEL05 | 300 mg/m² |
| LATEX03 | 450 mg/m² |
| Surfactant Nr S10 | 3 mg/m² |
| Surfactant Nr S11 | 1 mg/m² |
| Polystyrene sulfonic acid | 8 mg/m² |

and finally with a layer of composition:

| | |
|---|---|
| GEL08 | 1266 mg/m$^2$ |
| GEL09 | 100 mg/m$^2$ |
| GEL10 | 130 mg/m$^2$ |
| Surfactant Nr S09 | <5 mg/m$^2$ |
| Surfactant Nr S10 | 80 mg/m$^2$ |
| Surfactant Nr S11 | 3 mg/m$^2$ |
| anti-bacterial agent | 50 mg/m$^2$ |
| LATEX04 | 100 mg/m$^2$ |
| PLEXIGUM ™ M345 | 50 mg/m$^2$ |
| dioctadecyl phthalate | 5 mg/m$^2$ |
| formaldehyde | 106 mg/m$^2$ |
| sodium sulphate | 1 mg/m$^2$ |

Thermosensitive Element

A 175 $\mu$m thick polyethylene terephthalate support with an uncoated subbing layer 01 on one side and backing layer B01 on the other was used for the thermographic recording material of INVENTION EXAMPLE 14 and a 175 $\mu$m thick polyethylene terephthalate support with uncoated subbing layer 01 on one side and backing layer B02 on the other was used for the thermographic recording material of INVENTION EXAMPLE 15.

A thermosensitive element of the following composition was applied in each case to the side coated with subbing layer 01:

| | thermosensitive element of INVENTION EXAMPLE 14 | thermosensitive element of INVENTION EXAMPLE 15 |
|---|---|---|
| AgBeh | 5.031 g/m$^2$ | 5.268 g/m$^2$ |
| Surfactant Nr. 1 | 0.503 g/m$^2$ | 0.527 g/m$^2$ |
| GEL05 | 2.660 g/m$^2$ | 2.785 g/m$^2$ |
| LATEX 01 | 1.843 g/m$^2$ | 1.929 g/m$^2$ |
| R01 | 0.956 g/m$^2$ | 1.001 g/m$^2$ |
| T01 | 1.132 g/m$^2$ | 1.185 g/m$^2$ |
| Boric acid | 0.325 g/m$^2$ | 0.340 g/m$^2$ |
| HCHO | 0.192 g/m$^2$ | 0.201 g/m$^2$ |

Protective Layers

The thermosensitive elements of the thermographic recording materials of INVENTION EXAMPLES 14 and 15 were then coated with a protective layer with the following composition:

| | |
|---|---|
| POLY01 | 2.31 g/m$^2$ |
| SYLOID ™ 72 | 0.08 g/m$^2$ |
| SERVOXYL ™ VPDZ 3/100 | 0.07 g/m$^2$ |
| SERVOXYL ™ VPAZ 100 | 0.07 g/m$^2$ |
| MICROACE ™ TALC P3 | 0.04 g/m$^2$ |
| RILANIT ™ GMS | 0.13 g/m$^2$ |
| LEVASIL ™ VP AC 4055 | 0.50 g/m$^2$ |
| Formaldehyde | 0.52 g/m$^2$ |

Curl Evaluation Experiments

Curl evaluation experiments were carried out by hanging 24×30 cm$^2$ sheets for 4 hours at 20° C. and 10% and 85% relative humidity respectively in analogy with ISO Norm 4330-1979 (E) and then evaluating the degree of curl with a curl-meter The curl values in table 9 are the reciprocal of the curl radius in meters.

TABLE 9

| Invention example number | Curl at room temperature & 10% RH | Curl at room temperature & 85% RH |
|---|---|---|
| 14 | 10 | 3.3 |
| 15 | 6.6 | 4.5 |

From these tests it is clear that the thermographic recording material with the gelatin backing layer INVENTION EXAMPLE 15 exhibits significantly less curl than the thermographic recording material with the polymethylmethacrylate-based backing layer of INVENTION EXAMPLE 14.

Having described in detail preferred embodiments of the current invention, it will now be apparent to those skilled in the art that numerous modifications can be made therein without departing from the scope of the invention as defined in the following claims.

What is claimed is:

1. A thermographic recording material comprising a support and a thermosensitive element containing a substantially light-insensitive silver salt of an organic carboxylic acid, a reducing agent therefor in thermal working relationship therewith and at least one proteinaceous binder, wherein said thermosensitive element contains between 700 ppm and 5 ppm of a non-fluoro-halide ion with respect to said proteinaceous binders in said thermosensitive element and said thermographic recording material is thermally developable under substantially water-free conditions.

2. Thermographic recording material according to claim 1, wherein said thermosensitive element contains between 500 ppm and 5 ppm of a non-fluoro-halide ion with respect to said proteinaceous binders in said thermosensitive element.

3. Thermographic recording material according to claim 1, wherein said thermosensitive element contains between 300 ppm and 5 ppm of a non-fluoro-halide ion with respect to said proteinaceous binders in said thermosensitive element.

4. Thermographic recording material according to claim 1, wherein said proteinaceous binder(s) together contain between 700 ppm and 5 ppm of a non-fluoro-halide ion.

5. Thermographic recording material according to claim 1, wherein said proteinaceous binder(s) together contain between 500 ppm and 5 ppm of a non-fluoro-halide ion.

6. Thermographic recording material according to claim 1, wherein said proteinaceous binder(s) together contain between 150 ppm and 5 ppm of a non-fluoro-halide ion.

7. Thermographic recording material according to claim 1, wherein said proteinaceous binder(s) together contain an alkali metal ion concentration of 100 ppm or less.

8. Thermographic recording material according to claim 1, wherein said non-fluoro-halide ion is a chloride ion.

9. Thermographic recording material according to claim 1, wherein at least one of said proteinaceous binders is gelatin.

10. Thermographic recording material according to claim 1, wherein said thermographic recording material is provided with a layer containing a second proteinaceous binder on the opposite side of said support to said thermosensitive element.

11. Thermographic recording material according to claim 1, wherein said thermosensitive element further contains a photosensitive silver halide.

12. A process for producing a thermographic recording material having a support and a thermosensitive element, said thermosensitive element containing a substantially light-insensitive silver salt of an organic carboxylic acid, a reducing agent therefor in thermal working relationship therewith and at least one proteinaceous binder, comprising the steps of: preparing an aqueous dispersion of a substantially light-insensitive silver salt of an organic carboxylic acid; preparing one or more aqueous coating compositions containing together said aqueous dispersion of said substantially light-insensitive silver salt of an organic carboxylic acid, a reducing agent and at least one proteinaceous binder; and applying said one or more aqueous coating compositions to a support thereby forming after drying said thermographic recording material, wherein said thermosensitive element contains between 700 ppm and 5 ppm of a non-fluoro-halide ion with respect to said proteinaceous binders in said thermosensitive element and said thermographic recording material is thermally developable under substantially water-free conditions.

* * * * *

UNITED STATES PATENT AND TRADEMARK OFFICE

CERTIFICATE OF CORRECTION

PATENT NO. : 6,184,179 B1
DATED : February 6, 2001
INVENTOR(S) : Gilliams et al.

It is certified that error appears in the above-identified patent and that said Letters Patent is hereby corrected as shown below:

Column 1,
Lines 5-6, ", now abandoned" should be deleted.

Signed and Sealed this

Sixth Day of November, 2001

*Attest:*

Nicholas P. Godici

NICHOLAS P. GODICI
*Acting Director of the United States Patent and Trademark Office*

*Attesting Officer*